United States Patent [19]

Urani

[11] Patent Number: 4,690,648

[45] Date of Patent: Sep. 1, 1987

[54] CARTRIDGE FUSE HOLDER

[75] Inventor: Angelo Urani, Ellisville, Mo.

[73] Assignee: Cooper Industries, Inc., Houston, Tex.

[21] Appl. No.: 720,503

[22] Filed: Apr. 5, 1985

[51] Int. Cl.[4] ..... H01R 13/08; H01R 13/68

[52] U.S. Cl. ..... 439/622; 439/819; 439/884; 337/198; 337/213

[58] Field of Search ..... 339/147 R, 147 P, 108 TP, 339/255 R, 255 A, 255 B, 278 M, 278 T, 277 R, 277 C, 195 R, 195 A, 195 L, 195 M, 195 S, 196 R, 196 A, 196 M; 337/195, 198, 201, 213, 264

[56] References Cited

U.S. PATENT DOCUMENTS

| | | | |
|---|---|---|---|
| 1,866,363 | 7/1932 | Lieberum | 339/195 R |
| 2,808,485 | 10/1957 | Cardone | 337/198 |
| 2,910,562 | 10/1959 | Bussmann | 337/194 |
| 2,915,737 | 12/1959 | Morse | 339/195 R |
| 2,952,832 | 9/1960 | Chandler | 339/277 R |
| 3,434,095 | 3/1969 | DeRose | 339/255 R |
| 3,546,661 | 12/1970 | Urani | 339/195 R |
| 3,890,027 | 6/1975 | Orr et al. | 339/255 R |
| 3,891,292 | 6/1975 | Blight et al. | 339/147 R |

FOREIGN PATENT DOCUMENTS

| | | | |
|---|---|---|---|
| 1159999 | 7/1969 | United Kingdom | 339/147 R |

*Primary Examiner*—Gil Weidenfeld
*Assistant Examiner*—Gary F. Paumen
*Attorney, Agent, or Firm*—Nelson A. Blish; Eddie E. Scott; Alan R. Thiele

[57] ABSTRACT

A cartridge fuse holder having a stationary electrical contact adapted to engage one of the end terminals of a cartridge fuse and a movable electrical contact adapted to engage the other end terminal of the fuse. The moveable contact includes a T-shaped electrical contact formed from an integral sheetmetal blank which is reciprocably mounted within the fuse holder in a fashion biasing it against its respective fuse terminal.

10 Claims, 5 Drawing Figures

CARTRIDGE FUSE HOLDER

BACKGROUND OF THE INVENTION

1. Field of the Invention

This invention relates to fuse holders for an electrical circuit and in particular to the electrical contacts within the fuse holder.

2. Description of the Prior Art

The prior art includes a variety of cartridge fuse holders for electrical circuits. In a typical arrangement, the fuse holder is provided with a tubular body having an electrical contact at each of its ends adapted to engage the respective terminals on the ends of the fuse. Additionally, some means is usually provided to tighly clamp the electrical contacts to the terminals to minimize electrical resistence in the joints between the contacts and the terminals.

U.S. Pat. Nos. 2,910,562 and 3,546,661 are fairly representative of the fuse holders heretofore in use. Each of those fuse holders is provided with a tubular body or casing adapted to retain a cartridge fuse, and an electrical contact at each end of the body adapted to engage the terminals on the ends of the fuse. As shown in those patents, one of the contacts is fixed or stationary within the body and the other contact is movably mounted in an arrangement incorporating a spring to bias the moveable contact against its adjacent fuse terminal in a fashion which also tightly clamps together the contact and the fuse terminal at the other end of the fuse. Each of the movable contacts includes a round or tubular shaft reciprocably mounted through one of the ends of the body which has a relatively flat head adapted to engage its adjacent terminal. While this arrangement has proven to be very effective in maintaining the integrity of the electrical joints within the fuse holder, it is relatively expensive to fabricate and assemble. For example, in both of the fuse holders shown, it has generally been necessary to die stamp the outer ends of the tublar shafts after they are assembled within their respective fuse holders and then planish those ends to the thickness required to accommodate the quick connect type sockets proscribed for the particular fuse holder concerned.

SUMMARY OF THE INVENTION

This invention relates to cartridge fuse holders for an electrical circuit and in particular to a fuse holder having a movable electrical contact formed from an integral blank of conductive material adapted to be readily assembled within the fuse holder in a fashion accommodating alignment of the contact on a fuse panel or other supporting structure.

The fuse holder embodying the invention includes a body formed of a non-conductive material having an elongated bore open at one end and closed at its other end which is sized to receive a cartridge fuse having a terminal at each of its ends, and a removable mounting cap releasably secured to the body over the open end of the bore which is adapted to retain the fuse within the elongated bore. As in the case of the fuse holders discussed above in regard to the prior art, an electrical contact is provided at each end of the elongated bore which is adapted to engage its respective adjacent terminal on the fuse. The contact at the open end of the bore is mounted in a relatively fixed or stationary manner, and the contact at the closed end of the bore is movably mounted within the bore adjacent a compression spring which biases it against its respective fuse terminal.

In contrast to the prior art, the movable contact includes a generally T-shaped contact formed from an integral blank of sheetmetal or other electrically conductive material. The T-shaped contact includes a contact head portion sized to reciprocate within the elongated bore and a relatively flat shaft portion extending from the head portion which is adapted to extend through a second bore in the closed end of the body of generally the same cross-section as the shaft portion. This arrangement accommodates inserting the shaft portion through the second bore to position the T-shaped contact within the elongated bore with a compression spring sandwiched between the head portion and the closed end of the bore, and then securing the contact within the bore by forming a barb or other suitable stop in the shaft portion on the outside of the body to retain the shaft portion within the bore.

From the foregoing, it can be seen that the invention provides a movable contact arrangement which is relatively easy to fabricate and assemble within the fuseholder. Additionally, by forming the contact from an integral blank of sheetmetal or the like, the thickness of the outer end of the shaft portion can be easily selected and controlled by simply selecting a sheet stock having the thickness required for the desired quick connect coupling, thereby entirely eliminating the planishing and die stamping operation heretofore required after assembling the movable contact within the fuse holder. Moreover, since the relatively flat, rectangular cross-section of the shaft portion and the second bore prevent the contact from rotating within the holder once it is installed, a workman is able to easily orient the contact within a fuse panel or other supporting structure.

When considering the foregoing, it is to be understood that various changes can be made in the arrangement, form and construction of the apparatus disclosed herein without departing from the scope and spirit of the invention.

DESCRIPTION OF THE PREFERRED EMBODIMENT

Figure 1:
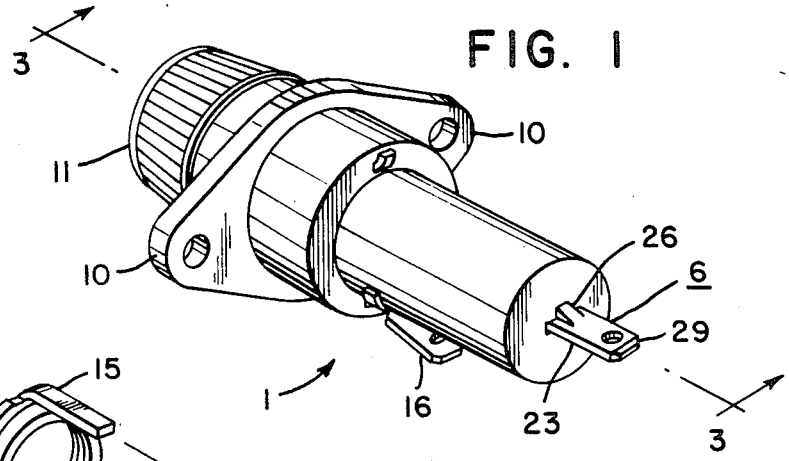
FIG. 1 is a perspective view of the fuse holder embodying the invention.
Figure 2:
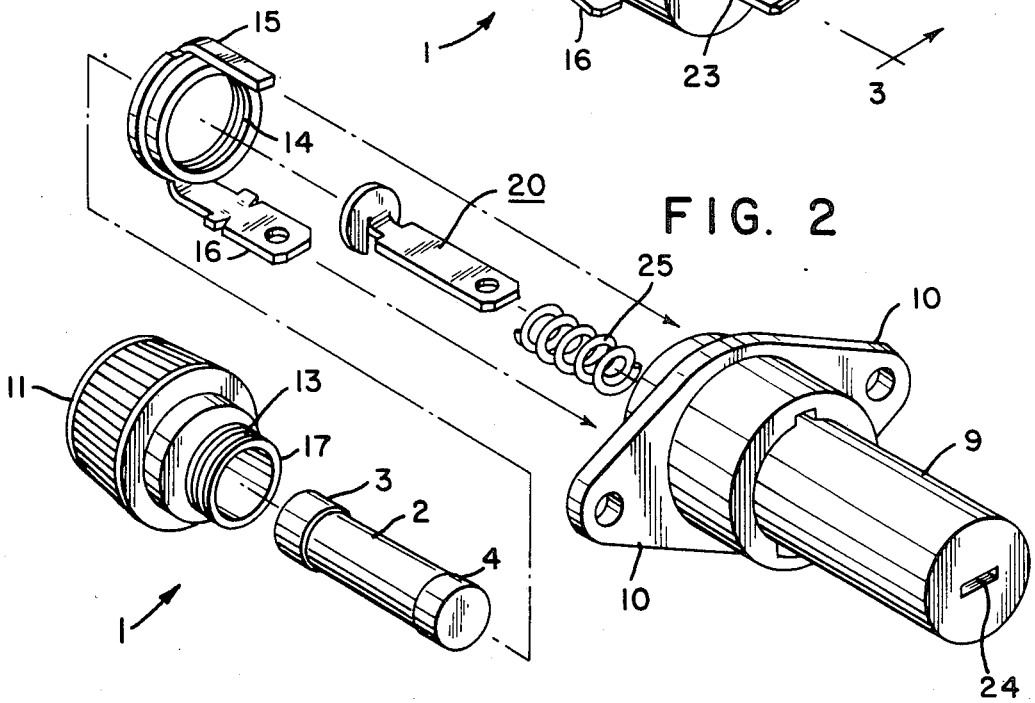
FIG. 2 is an exploded perspective view of the fuse holder shown in FIG. 1.
Figure 3:
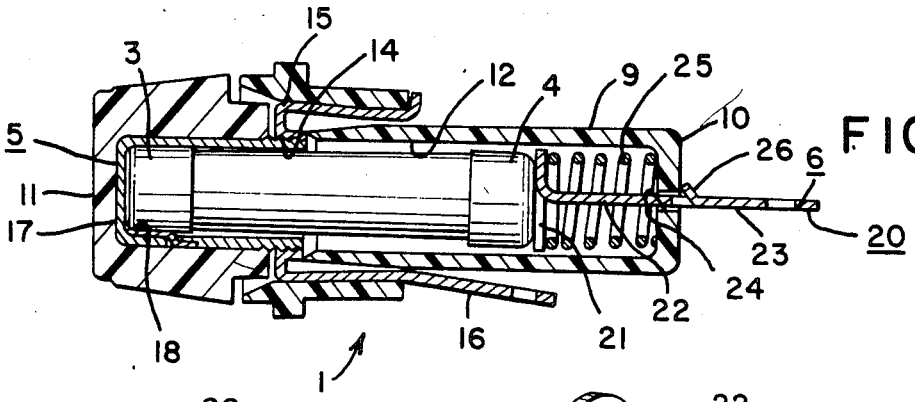
FIG. 3 is a cross-sectional view taken generally along line 3—3 in FIG. 1.

FIGS. 1–3 show a cartidge fuse holder 1 for a cartridge fuse 2 having end terminals 3 and 4. As will be described, the fuse holder 1 includes a stationary electrical contact 5 engaging the end terminal 3 and a movable electrical contact 6 engaging the end terminal 4.

The fuse holder 1 includes a tubular body 9 having a pair of flanges 10 for mounting the fuse holder 1 on an appropriate fuse panel (not shown) and a mounting cap 11 formed of a relatively hard, nonconductive material such as a phenolic plastic. As shown in FIG. 3, the tubular body 10 is provided with an elongated bore 12 which is sized to receive the cartridge fuse 2, and the mounting cap 11 is formed to fit over the open end of the elongated bore 12 to enclose the fuse 2 within the body 10. In the embodiment shown, threading 13 is provided on the structure of the mounting cap 11 which is adapted to screw into threading 14 provided in a metal ring 15 secured to the body 10 within the bore 12 which is in turn connected to a metal strip forming a contact terminal 16. This arrangement accommodates releasably securing the cap 11 to the body 10 while at the same time completing the electrical connection between the fuse terminal 3 and the stationary electrical contact 5 as will be described.

The stationary electrical contact 5 includes a metal cup 17 secured within the interior of the mounting cap 11. As can be seen from the drawings, the metal cup 17 is sized to fit over the end terminal 3 and includes a resilient metal clip 18 in the base of the cup 17 which is adapted to firmly grip the terminal 3 to secure the fuse 2 within the cup 17. This enhances the electrical connection between the cup 17 and the fuse terminal 3 while at the same time simplifying insertion and removal of the fuse 2 from the bore 12.

The movable contact 6 includes a generally T-shaped metal contact 20 having a contact head portion 21 reciprocably mounted within the elongated bore 12 which is adapted to abut the fuse terminal 4, and a relatively flat shaft portion 22 forming a contact terminal 23 projecting from the head portion 21 through a bore 24 in the base of the body 10 at the base of elongated bore 12. As shown in FIG. 3, a coiled compression spring 25 is sandwiched between the base of the elongated bore 12 and the head portion 21 which is sized to urge the T-shaped contact 20 against the fuse terminal 4, and a barb or other suitable stop 26 is formed in the outer end of the shaft portion 22 which is adapted to abut the closed end of the body 10 to retain the T-shaped contact 20 within the bore 12. When considering the foregoing, it should be noted that the bore 24 is of a rectangular cross-sectional configuration sized to accommodate reciprocation of the shaft portion 22 while preventing its rotation within the bore 24. This arrangement has been found to be particularly convenient since it fixes the angular alignment of the contact terminal 23 within the fuse holder 1 so a workman can readily align and secure the fuse holder to an appropriate mounting panel to facilitate securing quick connect electrical couplings to the contact terminals 16 and 23 in the field.

Figure 4:
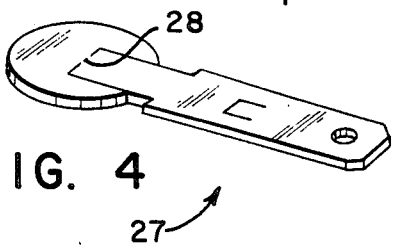
FIG. 4 is a plan view of the sheetmetal blank prior to forming it into the T-shaped contact.
Figure 5:
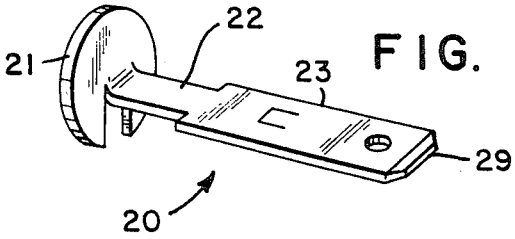
FIG. 5 is a perspective view of the T-shaped contact ready to be assembled in the fuse holder.

As noted above, the invention discloses a relatively simple and straight forward method of fabricating the T-shaped contact 20 and then assembling it in the fuse holder 1. Referring to FIG. 4, the T-shaped contact 20 is formed from an integral blank of sheetmetal 27 and then bent along the line indicated at 28 into the configuration shown in FIG. 5. The sheetmetal, which is preferably coated with an electrically conductive metal plating, should have a thickness equal to the thickness of the electrical terminal the desired quick connect electrical coupling is designed to recieve. Additionally, prior to assembling the contact 20 within the fuse holder, the outer end of the shaft portion 22 should be beveled as indicated at 29 by coining, grinding or other appropriate means. Once this is completed, the T-shaped contact 20 can be assembled in the fuse holder 1 by inserting it into the elongated bore 12 as noted above and bending the barb 26 outward to secure the contact within the bore 12.

I claim:

1. In a cartridge fuse holder for an electrical circuit including a body having an elongated bore open at one end and closed at its other end sized to receive a cartridge fuse having an electrical terminal at each of its ends, a removable mounting cap releasably secured to the body over the open end of the bore adpated to retain the fuse within the bore, and a stationary electrical contact adapted to engage the fuse terminal proximate the open end of the bore to connect said terminal to the electrical circuit, the improvement comprising a movable electrical contact adapted to connect the other fuse terminal proximate the other end of the bore to the electrical circuit, including:

a generally T-shaped contact formed from an integral sheet metal blank of electrically conductive material having a contact head portion reciprocably mounted within the elongated bore adapted to abut said other fuse terminal and a relatively flat shaft portion bent perpendicularly from said head portion, said shaft being located at the approximate center of said T-shaped contact;

a second bore of substantially the same cross-section as said flat shaft portion extending through the closed end of the body having said shaft portion extending therethrough;

spring means within the elongated bore interposed between the closed end of the body and the said head portion adapted to urge the head portion against said other terminal; and stop means on said shaft portion outwardly of the body retaining said movable contact within the elongated bore.

2. The movable electric contact in the cartridge fuse holder of claim 1, and said integral blank being formed of a sheetmetal blank.

3. The movable electric contact in the cartridge fuse holder of claim 1, and said spring means being a coil comprssion spring disposed about said flat shaft portion abutting said head portion and the closed end of the body.

4. The movable electric contact in the cartridge fuse holder of claim 1, and said stop means being a barb formed in said shaft portion after assembly of the shaft portion within the second bore.

5. The movable electric contact in the cartridge fuse holder of claim 1, and said flat shaft portion having a beveled outer end.

6. A cartridge fuse holder for an electrical circuit, comprising:

a body formed of a non-conductive material having an elongated bore open at one end and closed at its other end sized to receive a cartridge fuse having an electrical terminal at each of its ends;

a removable mounting cap releasably secured to the body over the open end of the bore adapted to retain the fuse within the bore;

a stationary electrical contact adapted to engage the fuse terminal proximate the open end of the bore to connect said terminal to the electrical circuit; and a movable electrical contact adapted to connect the other fuse terminal proximate the other end of the bore to the electrical circuit;

said movable electrical contact including a generally T-shaped contact formed from an integral sheet metal blank of electrically conductive material having a contact head portion reciprocably mounted within the elongated bore adapted to abut said other fuse terminal and a relatively flat shaft portion bent perpendicularly from said head portion, said shaft being located at the approximate center of said T-shaped contact, a second bore of substantially the same cross-section as said flat shaft portion extending through the closed end of the body having said shaft portion perpendicularly extending therethrough, spring means within the elongated bore interposed between the closed end of the body and said head portion adapted to urge the head portion against said other terminal, and stop means on said shaft portion outwardly of the body retaining said T-shaped contact within the body.

7. The cartridge fuse holder of claim 6, and coupling means on said body adapted to selectively secure the body to a supporting panel with the surface of the flat shaft portion positioned in predetermined angular alignment with respect to the supporting panel.

8. The cartridge fuse holder of claim 6, and said T-shaped contact being formed of a sheetmetal blank coated with an electrically conductive corrosion resistent metal plating.

9. A method for fabricating a movable electrical contact and assembling it in a cartridge fuse holder of an electrical circuit including a body having an elongated bore open at one end and closed at its other end sized to receive a cartridge fuse having an electrical terminal at each of its ends, a removable mounting cap releasably secured to the body over the open end of the bore adapted to retain the fuse within the bore, and a stationary electrical contact adapted to engage the fuse terminal proximate the open end of the bore to provide means for connecting said terminal to the electrical circuit, comprising the steps of:

cutting an integral blank of sheetmetal of a predetermined thickness to form an elongated rectangular shaft portion and a circular head portion at one end of the shaft portion;

bending the integral blank at the juncture of said head and shaft portions to form a generally T-shaped contact, said shaft being located at the approximate center of said T-shaped contact;

forming a second bore of substantially the same cross-section as said shaft portion through the closed end of the body;

positioning spring means within the elongated bore proximate the outer end of the body;

inserting said shaft portion through the second bore in a fashion positioning said head portion within the elongated bore adjacent said spring means; and forming stop means in said shaft portion outwardly of the body to retain the T-shaped contact within the body while utilizing said spring means to urge said contact head portion against the other terminal of the fuse to provide means for connecting said other terminal to the electrical circuit.

10. The method of claim 9 including the step of:

forming a bevel on the end of said shaft portion prior to inserting it through the second bore.

* * * * *